US006196559B1

(12) United States Patent
Cress

(10) Patent No.: US 6,196,559 B1
(45) Date of Patent: Mar. 6, 2001

(54) SNOWBOOT BINDING

(76) Inventor: Scott Cress, 3258-A Kaimuke Ave., Honolulu, HI (US) 96816

( * ) Notice: Subject to any disclaimer, the term of this patent is extended or adjusted under 35 U.S.C. 154(b) by 0 days.

(21) Appl. No.: 09/184,677

(22) Filed: Nov. 2, 1998

(51) Int. Cl.[7] ..... B62B 9/04
(52) U.S. Cl. ..... 280/14.22
(58) Field of Search ..... 280/14.2, 618, 280/617, 14.22

(56) References Cited

U.S. PATENT DOCUMENTS

| | | | | |
|---|---|---|---|---|
| 5,035,443 | * | 7/1991 | Kincheloe | 280/14.2 |
| 5,261,689 | * | 11/1993 | Carpenter et al. | 280/618 |
| 5,299,823 | * | 4/1994 | Glaser | 280/625 |
| 5,499,837 | * | 3/1996 | Hale et al. | 280/607 |
| 5,505,478 | * | 4/1996 | Napoliello | 280/618 |
| 5,520,406 | * | 5/1996 | Anderson et al. | 280/14.2 |
| 5,655,786 | * | 8/1997 | Raftogianis | 280/14.2 |
| 5,975,556 | * | 11/1999 | Lehmann | 280/14.2 |

* cited by examiner

*Primary Examiner*—Brian L. Johnson
*Assistant Examiner*—G B Klebe

(57) ABSTRACT

A snowboot binding used for mounting on top of a snowboard. The snowboot binding adapted for engaging the sides and bottom of a sole of a snowboot and a heel of the snowboot. The binding having a horizontal baseplate with a front, a rear, a center portion and a first side and a second side on opposite sides of the center portion. Along the length of the first side of the base plate is an upwardly extending inverted "L" shaped first rail. Also, along the length of the second side of the base plate is an upwardly extending inverted "L" shaped second rail. A portion of the two "L" shaped rails are received in sole interface grooves formed in opposite sides of the sole of the snowboot. Mounted on one side of the first rail is a spring biased locking pin release lever having a locking pin extending inwardly toward the side of the sole of the snowboot. The sole having a snow cavity therein with a locking pin bar mounted on the side of the sole and in front of the cavity. The bar adapted for receiving a portion of the locking pin therein when the sole of the snowboot is received along the length of the first and second rails. The baseplate also includes an alignment tab extending upwardly along the length of the center portion. The alignment tab is adapted for receipt in a sole alignment groove along the length of the sole.

8 Claims, 2 Drawing Sheets

SNOWBOOT BINDING

BACKGROUND OF THE INVENTION (a) Field of the Invention

This invention relates to bindings for boots and more particularly, but not by way of limitation, to a snowboot binding used for mounting on top of a snowboard.

(b) Discussion of Prior Art

In the ski industry, there are generally two types of bindings. One is a high back or buckle binding and the other is a plate binding. The high back or buckle binding is designed for use with soft boots and is constructed of plastic. The conventional high back binding includes a base plate, a high back support and various types of straps. The basic design of the plate binding consists of a rigid base plate or a toe and heel plate having extensions for clamping a hard shell boot thereon.

While there are numerous types of prior art snowboard bindings, all of the bindings include a base plate or are plateless. A major disadvantage of the prior art snowboard bindings is the lack of control associated with the binding straps which lacked the leverage and/or durability to adequately tighten the straps on the snowboot.

Early strap systems for snowboard bindings include the use of hook and loop fasteners. Later bindings rely on the user adjusting the strap so that connecting buckles were in close proximity when physically forcing them into a locked position. This type of binding was replaced by cam lever buckles with wire bales attached to one end of the strap. Slotted blocks were fitted on the end of the other strap into which the bales could be attached. These type of cam lever buckles allow only about a half inch take up by mechanical leverage after the mating parts are physically forced close enough together to make a connection. This type of binding provides inadequate tension allowing the wire bales to slip out of the blocks when a snowboarder's soft boots are compressed as a result of jumping or maneuvering.

A current strap binding for soft boots and used on most mass produced snowboards employ a ratchet buckle and strap. The binding is described in U.S. Pat. No. 3,662,435 to Ivor J. Allsop. This binding is an improvement over earlier bindings inasmuch as the serrated plastic strap does not slip out of a spring loaded metal clamp when the rider's boot is compressed during jumps and maneuvers. However, because the strap still has to be forced into the spring loaded metal clamp, it is cumbersome to use. Also, the thin serrated strap is made of plastic which becomes brittle with age and unlike fabric it ages rapidly or it become brittle in cold weather which ever comes first and cannot reliably withstand stock during jumps and maneuvers. A broken strap will prevent a snowboarder from maintaining control of the board.

A further disadvantage of prior art snowboard binding straps is the need to use both hands to buckle and unbuckle the straps. This is because all prior art devices require some physical force to urge the strap or wire bale into a holding mechanism before a cam lever can be activated. In the release process, the cam lever has to be released and the spring loaded clamp has to be depressed while the bale or strap is removed from the slotted block or clamp.

Therefore, because of the above mentioned disadvantages of current bindings for snowboards, there is a need for a binding which is durable, not adversely affected by cold weather and whose mating parts can be attached without the snowboarder having to use physical force. The subject invention solves the above mentioned problems with the following objects and advantages as described herein.

None of the above mentioned prior art snowboard bindings provide a unique combination of structure and features of the subject snowboot binding adapted for engaging the sides and bottom of a sole of the snowboot and the heel of the snowboot.

SUMMARY OF THE INVENTION

In view of the foregoing, it is a primary object of the subject invention to provide a snowboot binding which can be quickly attached to the sides and bottom of a sole of a snowboot and released from the snowboot.

Another object of the subject snowboot binding is to eliminate the use of binding straps, cam levers and wire bales which heretofore were difficult to use, to clamp, to tighten and release from a snowboot.

Still another object of the invention is the binding is not effected by cold weather and is easy to use without having to apply physical force in engaging and releasing the snowboot from the binding.

Yet another object of the new binding is to fit the binding snugly on the bottom of the sole of the snowboot and engage the heel of the snowboot for increased stability and mobility when snowboarding.

The subject invention includes a horizontal baseplate with a front, a rear, a center portion and a first side and a second side on opposite sides of the center portion. Along the length of the first side of the base plate is an upwardly extending inverted "L" shaped first rail. Also, along the length of the second side of the base plate is an upwardly extending inverted "L" shaped second rail. A portion of the two "L" shaped rails are received in sole interface grooves formed in opposite sides of the sole of the snowboot. Mounted on one side of the first rail is a spring biased locking pin release lever having a locking pin extending inwardly toward the side of the sole of the snowboot. The sole having a snow cavity therein and with a locking pin bar mounted on the side of the sole and in front of the cavity. The locking pin bar adapted for receiving a portion of the locking pin therein when the sole of the snowboot is received along the length of the first and second rails. The baseplate also includes an alignment tab extending upwardly along the length of the center portion. The alignment tab is adapted for receipt in a sole alignment groove along the length of the sole. The alignment tab provides for proper alignment of the snowboot on top of the baseplate.

These and other objects of the present invention will become apparent to those familiar with the different types of downhill and crosscountry ski bindings and snowboard bindings when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
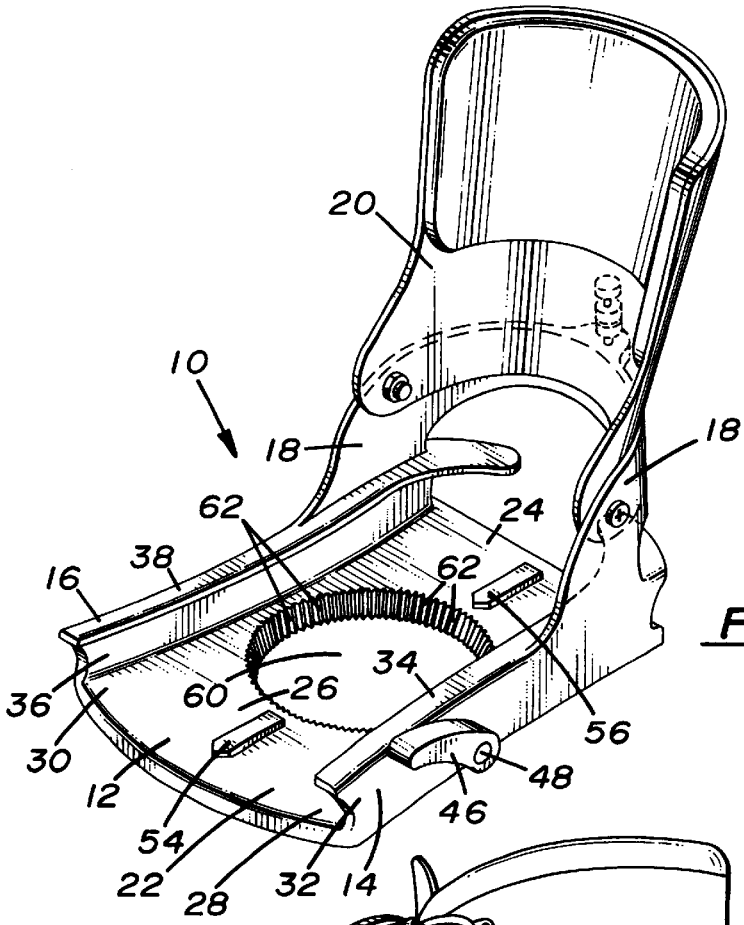
FIG. 1 is a perspective view of the subject snowboot binding prior to mounting on top of a snowboard. Broadly the snowboot binding includes a baseplate with rails thereon and a curved heel plate extending upwardly from the rear of the baseplate. The heel plate is shown with a boot highback pivotly mounted to the top thereof.

In FIG. 1, a perspective view of the subject snowboot binding prior to mounting on top of a snowboard. The snowboot binding is designated by general reference numeral 10. Broadly, the snowboot binding 10 includes a baseplate 12 with an inverted "L" shaped first rail 14 and an inverted "L" shaped second rail 16 integrally formed along the sides of the baseplate 12. Also, a curved heel plate 18 is integrally formed and extends upwardly from the rear of the baseplate 12. The heel plate 18 is shown with a boot highback 20 pivotably mounted to the top thereof. The boot highback 20 is not part of the subject invention.

The baseplate 12 includes a front portion 22, a rear portion 24, a center portion 26 and a first side 28 and a second side 30 on opposite sides of the center portion 26. Along the length of the first side 28 of the base plate 12 is the upwardly extending inverted "L" shaped first rail 14. The first rail 14 includes a vertical arm 32 and a horizontal groove flange 34. Also, along the length of the second side 30 of the base plate 12 is the upwardly extending inverted "L" shaped second rail 16. The second rail 16 includes a vertical arm 36 and a horizontal groove flange 38. A portion of the two groove flanges 34 and 38 are received in a sole interface groove 40 formed in opposite sides of a sole 42 of a snowboot 44. The snowboot 44 with sole 42 is shown in FIGS. 2–5.

It should be mentioned that the snowboot binding 12 with baseplate 12 and rails 14 and 16 are anatomically designed for a right foot snowboot and a left foot snowboot. Therefore, the rails 14 and 16 are slightly curved to conform to the curvature of the soles of either the right or left foot boot. In FIG. 1, the binding 12 is for receiving the snowboot 44 for a left foot boot. It should be kept in mind, while the binding 12, as shown in the drawings, is designed for the boot for the left foot, the structure and function of the binding 12 for receiving and engaging either the left or right foot snowboot is the same.

In FIG. 1, a spring biased locking pin release lever 46 is shown mounted in the side of the vertical arm 32 of the first rail 14. The pin release lever 46 includes a locking pin 48 which extends inwardly toward the side of the sole 42 of the snowboot 44. The locking pin 48 is biased toward the side of the sole 42 by a coil spring. The coil spring is not shown in the drawings. The locking pin 48 is received in a selected hole 50 in a locking pin bar 52 attached to the side of the sole 42. The locking pin 48, the holes 50 and the locking pin bar 52 are shown in detail in FIGS. 4, 5 and 6.

Figure 4:
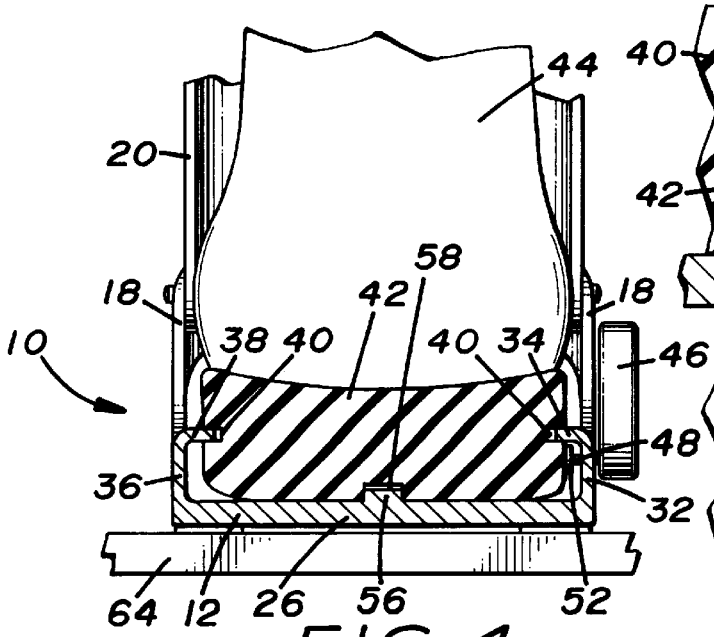
FIG. 4 is a sectional view of the snowboot and the snowboot binding taken along lines 4—4 shown in FIG. 3 and illustrating the rails received in the interface grooves in the opposite sides of the snowboot sole.

Also shown in FIG. 1, is the base plate 12 with the center portion 26 having a pair of parallel upright alignment tabs 54 and 56 disposed along a portion of the length of the base plate 12. The alignment tabs 54 and 56 are received inside an alignment groove 58 centered on and along the bottom and length of the snowboot sole 42. The alignment groove 58 is shown in FIG. 4.

Figure 2:
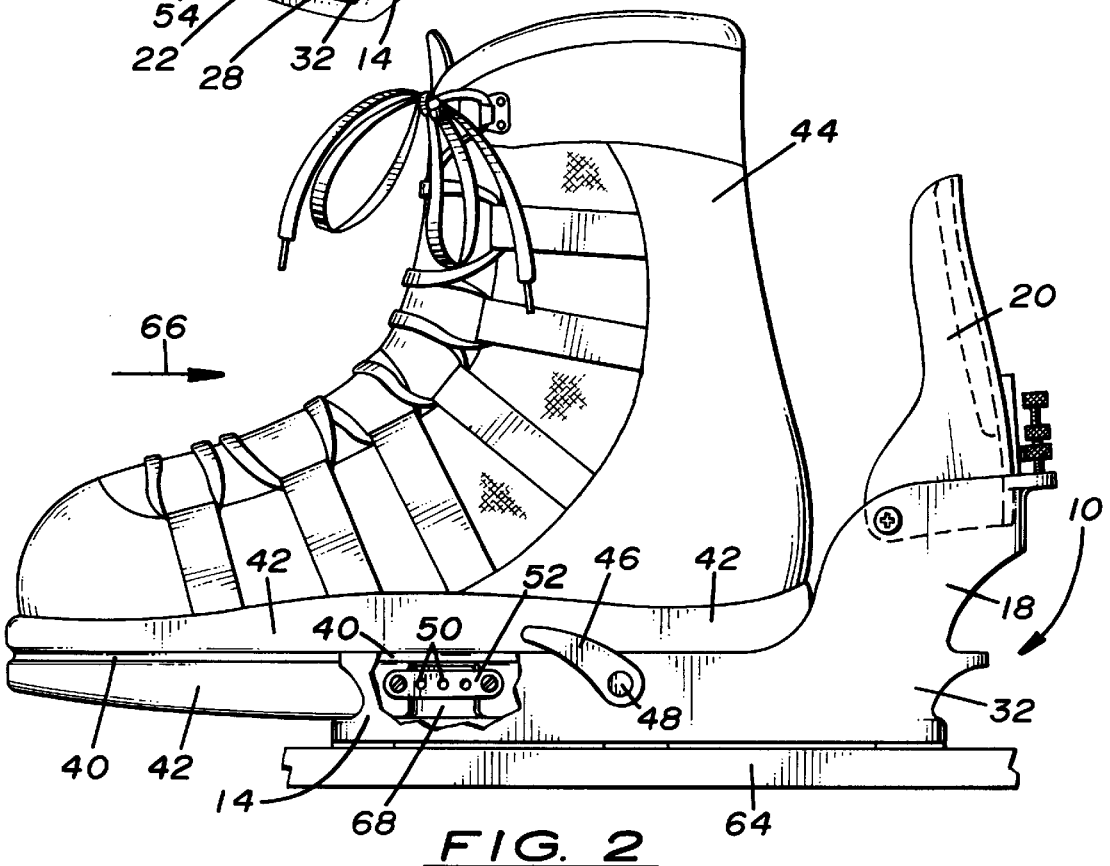
FIG. 2 is a side view of a snowboot positioned for receipt in the snowboot binding. The snowboot includes a sole with sole interface grooves on opposite sides of the sole. The binding includes rails which are slidably received in the interface grooves as the snowboot is slide rearwardly on the binding.
Figure 3:
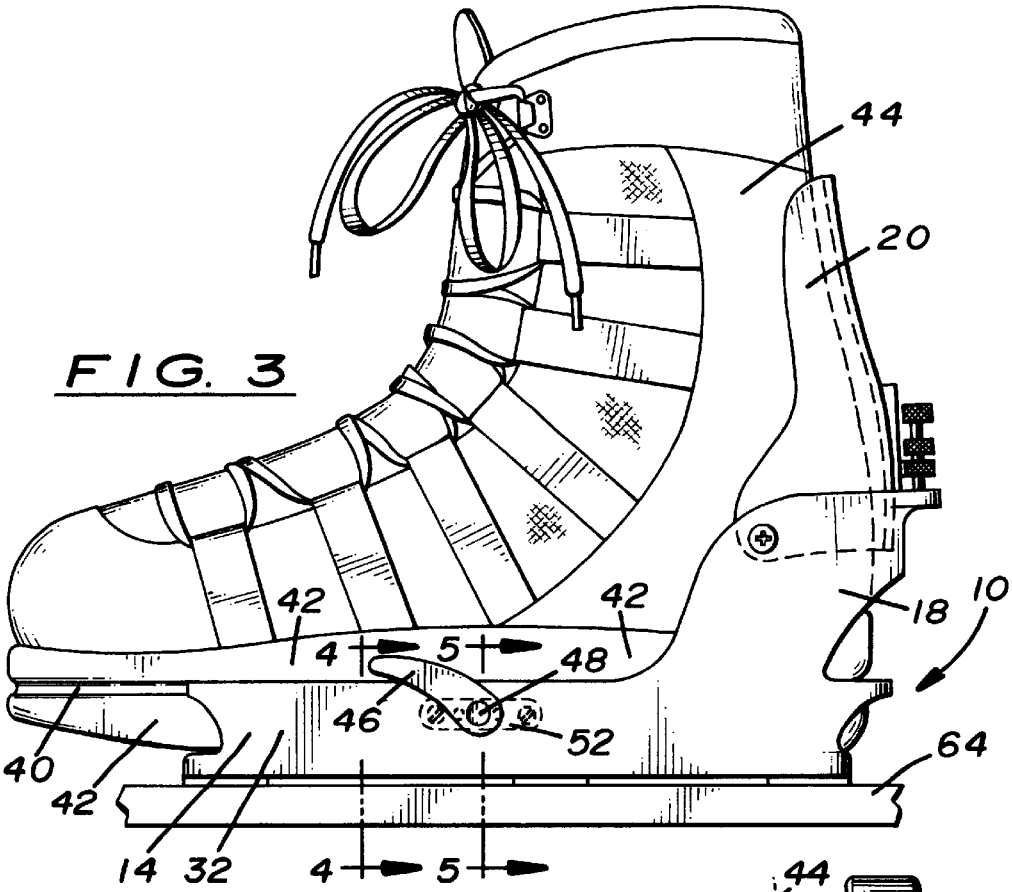
FIG. 3 is another side view of the snowboot with the snowboot received completely in the snowboot binding with a heel of the snowboot resting against the curved heel plate at the rear of the baseplate.

Further shown in FIG. 1, is the base plate 12 having an annular mounting disk opening 60 with beveled gear teeth 62 around the sides of the opening 60. A beveled mounting disk plate with gear teeth thereon is received over the opening 60 and secured to the gear teeth 62 for attaching the snowboot binding 10 at a selected angle on top of a snowboard 64. A portion of the snowboard 64 is shown in FIGS. 2, 3 and 4. The mounting disk plate is not shown in the drawings.

In FIG. 2, a side view of the snowboot 44 is shown and positioned for receipt in the snowboot binding 10. As mentioned above, the snowboot 44 includes the sole 42 with sole interface grooves 40 along the length of the opposite sides of the sole 42. In this drawing, a portion of the groove flanges 34 and 38 of the first and second rails 14 and 16 have been received in the sole interface grooves 40 as the snowboot 44 is moved rearwardly as indicated by arrow 66.

Also in this drawing, a portion of the first rail 14 has been cutaway to expose the locking pin bar 52 mounted on the side of the sole 42. The locking pin bar 52 is disposed in front of a snow cavity 68 carved into the side of the sole 42. The snow cavity 68 is designed to collect any loose snow when the locking pin 48 is inserted into one of the selected holes 50 in the locking pin bar 52. As the snowboot 44 and sole 42 are moved rearwardly on the rails 14 and 16, the locking pin bar 52 with holes 50 is indexed in front of the locking pin 48, with the locking pin 48 received through one of the holes 50 as shown in FIG. 5.

In FIG. 3, the snowboot 44 has completed its travel with the rear or heel of the snowboot resting against the curved heel plate 18 and the boot highback 20. In this drawing, the length of the horizontal groove flanges 34 and 38 are completely received in the sole interface grooves 40 on both sides of the sole 40 for holding the snowboot 44 in place on the snowboot boot binding 10. Also, to insure that the snowboot 44 does not slide forward on the first and second rails 14 and 16, the locking pin 48 has been inserted into a selected hole 50 in the locking bar pin 52.

In FIG. 4, a sectional view of the snowboot 44 and the snowboot binding 10 is illustrated and taken along lines 4—4 shown in FIG. 3. In this view, the sole 42 and the baseplate 12 are shown in cross section with the sole interface grooves 40 on both sides of the sole 42 receiving the ends of the groove flanges 34 and 38 therein. Also in this drawing, the alignment groove 58 along the length and in the center of the sole 42 is shown receiving the alignment tab 56. Also shown in this drawing is a side view of an end of the locking pin 48 received in a hole 50 in the locking pin bar 52.

Figure 5:
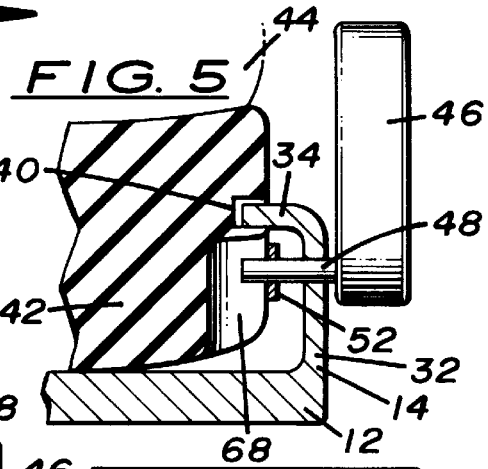
FIG. 5 is an enlarged sectional view taken along lines 5—5 shown in FIG. 3 and disclosing a portion of the baseplate, snowboot sole, a locking pin release lever and a locking pin received in a hole in a locking pin bar mounted on the side of the sole.

In FIG. 5, an enlarged sectional view taken along lines 5—5 in FIG. 3 is shown illustrating a portion of the baseplate 12 and first rail 14 and a portion of the snowboot sole 42. In this view, the locking pin 48 can be seen received through a selected hole 50 in the locking pin bar 52 with the end of the locking pin 48 received in the snow cavity 68. As mentioned above, the locking pin release lever 46 includes a coil spring for biasing the locking pin 48 inwardly into the cavity 68. Obviously, when it is desired to release the locking pin 48 from the locking pin bar 48, the locking pin release lever 46 would be pulled outwardly or to the right in the drawing for releasing the locking pin 48 therefrom.

Figure 6:
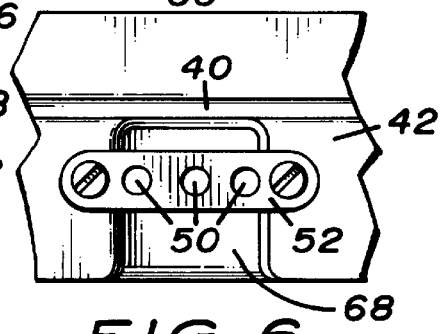
FIG. 6 is an enlarged front view of the locking pin bar and a snow cavity formed in the side of the snowboot sole.

In FIG. 6, an enlarged front view of the locking pin bar 52 is shown attached to the side of the sole 42. Also the snow cavity 68 is shown in the side of the snowboot sole 42. The locking pin bar 52 is shown with three holes 50 therein for selecting a hole for receiving the end of the locking pin 48 therethrough when securing the sole 42 of the snowboot 44 to the snowboot binding 10.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A snowboot binding used for mounting on top of a snowboard, the snowboot binding adapted for engaging sole interface grooves along opposite sides of a sole of a snowboot and a heel of the snowboot, the binding comprising:

a horizontal baseplate with a front, a rear, a center portion and a first side and a second side on opposite sides of the center portion;

an upwardly extending first rail attached along the first side of said baseplate;

an upwardly extending second rail attached along the second side of said baseplate, a portion of said first rail and a portion of said second rail adapted for slidable engagement in the sole interface grooves on opposite sides of the sole of the snowboot, having inwardly projecting flanges along the top of the full length of the rail, including a rearmost flange portion adapted to engage at least a portion of the rear of the snowboot heel when engaged by the snowboot, and locking means for releasably engaging the side of the snowboot sole and holding the snowboot on top of said baseplate.

2. The binding as described in claim 1 wherein said first rail is an inverted "L" shaped first rail integrally formed along a length of the first side of said baseplate and said second rail is an inverted "L" shaped first rail integrally formed along a length of the second side of said baseplate.

3. The binding as described in claim 2 wherein said first rail includes a vertical arm with a horizontal groove flange and said second rail includes a vertical arm with a horizontal groove flange, said flanges of said first and second rail adapted for slidable receipt in the sole interface grooves in opposite sides of the sole of the snowboot.

4. The binding as described in claim 1 wherein said locking means is attached to the side of said first rail.

5. The binding as described in claim 4 wherein said locking means is a spring biased locking pin release lever having a locking pin extending inwardly toward the side of the sole of the snowboot and adapted for receipt in a hole in a locking pin bar, the locking pin bar mounted on the side of the sole of the snowboot.

6. The binding as described in claim 1 further including a an alignment tab extending upwardly from said baseplate.

7. The binding as described in claim 6 wherein said alignment tab is disposed along a portion of the length of the center portion of said baseplate and centered thereon.

8. The binding as described in claim 1 further including a curved heel plate integrally formed in the rear of said base plate and extending upwardly therefrom.

* * * * *